US005273182A

United States Patent [19]

Laybourne

[11] Patent Number: 5,273,182

[45] Date of Patent: Dec. 28, 1993

[54] COASTER

[76] Inventor: Sidney C. Laybourne, 837 Ave. H, Fort Madison, Iowa 52627

[21] Appl. No.: 774,072

[22] Filed: Oct. 9, 1991

[51] Int. Cl.[5] ..... B65D 25/00

[52] U.S. Cl. ..... 220/740; 220/212; 220/737; 215/100.5; 215/228; 248/310; 248/311.2; 248/346.1

[58] Field of Search ..... 215/100.5, 228; 220/212, 737, 740; 248/310, 311.2, 346.1

[56] References Cited

U.S. PATENT DOCUMENTS

| | | | |
|---|---|---|---|
| 482,603 | 9/1892 | Weigel . | |
| 821,208 | 5/1906 | Voss . | |
| 980,852 | 1/1911 | Van Court . | |
| 1,862,533 | 6/1932 | Fish, Jr. | 215/100.5 |
| 1,957,263 | 5/1934 | Gray | 215/100.5 |
| 2,496,157 | 1/1950 | Gaudino . | |
| 2,570,954 | 10/1951 | Kasman | 215/100.5 |
| 2,641,911 | 6/1953 | Raymond et al. | 215/100.5 X |
| 2,652,703 | 9/1953 | Keegan . | |
| 2,672,250 | 3/1954 | Haslett | 215/100.5 |
| 2,709,905 | 6/1955 | Dunlap . | |
| 2,727,645 | 12/1955 | Dore . | |
| 2,955,722 | 10/1960 | Antonious . | |
| 3,013,688 | 12/1961 | Luning | 215/100.5 |
| 3,018,014 | 1/1962 | Opolion . | |
| 3,220,684 | 11/1965 | Milne . | |
| 3,257,092 | 6/1966 | Blundell . | |
| 3,268,198 | 8/1966 | Swett . | |
| 3,350,131 | 10/1967 | Tanzer | 215/100.5 |
| 3,598,271 | 8/1971 | Holley . | |
| 3,606,074 | 9/1971 | Hayes | 215/100.5 X |
| 3,633,863 | 1/1972 | Abbey | 248/346.1 |
| 4,040,535 | 8/1977 | Shephard | 215/100.5 |
| 4,681,239 | 7/1987 | Manns et al. | 220/408 |
| 4,759,525 | 7/1988 | Gross et al. . | |
| 4,858,872 | 8/1989 | Witt . | |
| 4,858,873 | 8/1989 | Wilmoth et al. . | |

FOREIGN PATENT DOCUMENTS

| | | | |
|---|---|---|---|
| 470129 | 12/1928 | Fed. Rep. of Germany | 215/100.5 |
| 566125 | 12/1932 | Fed. Rep. of Germany | 215/100.5 |
| 645282 | 4/1937 | Fed. Rep. of Germany | 215/100.5 |
| 1028688 | 5/1953 | France | 215/100.5 |
| 1092588 | 4/1955 | France | 215/100.5 |
| 294453 | 11/1989 | Japan | 215/228 |

*Primary Examiner*—Allan N. Shoap
*Assistant Examiner*—Stephen Cronin
*Attorney, Agent, or Firm*—Thomas E. Frantz

[57] ABSTRACT

A coaster for use with a beverage can, bottle or other container, the coaster being provided with an absorbent member having a seat sized to receive the bottom or foot of the container and a multiplicity of interconnected capillary spaces sized to receive and safely retain any moisture present or forming as condensate on and running or dripping from the container. Fixed relative to the absorbent member is a coupling member having a series of semi-resilient contact elements positioned to releasably engage the container and couple the coaster to the container as the container is placed on the coaster. The coaster thus remains on the container as it is picked up and moved about by one consuming beverage from the container. Also disclosed are embodiments of the invention having structure for sealably engaging the upper rim of the container to form a closure or cap for the upper end of the container. The various embodiments also are adapted to carry indicia such as advertising and promotional messages.

11 Claims, 4 Drawing Sheets

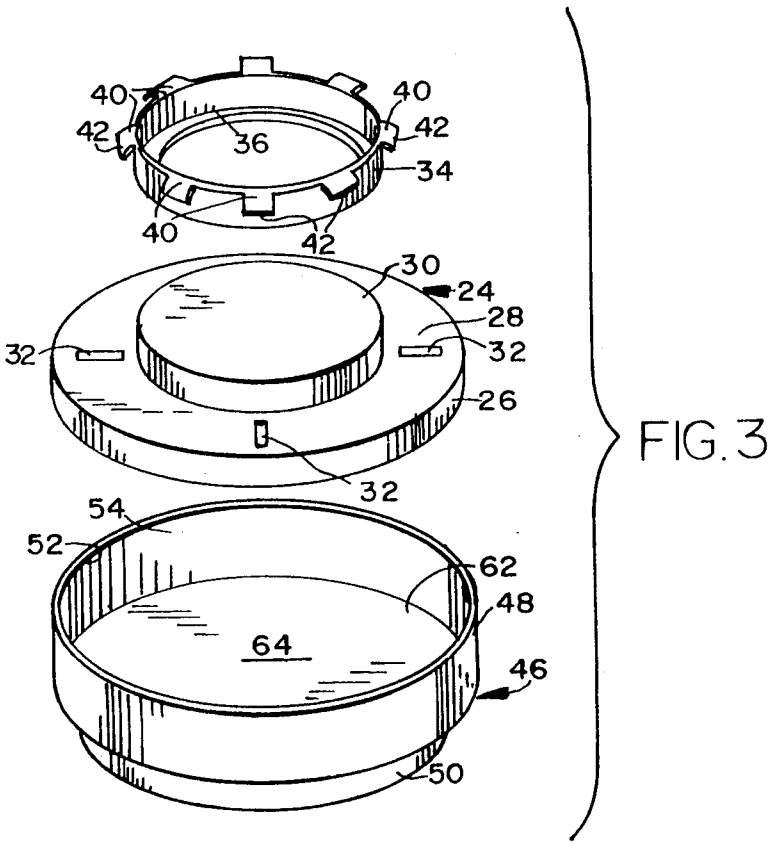
FIG. 3
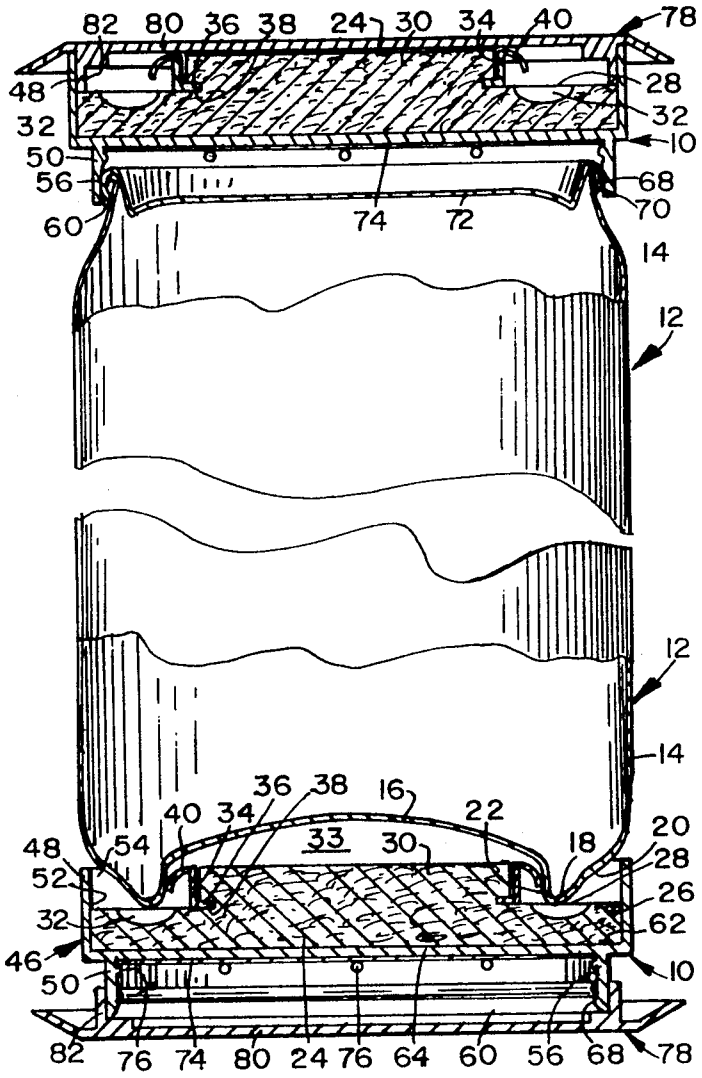
FIG. 2
FIG. 1

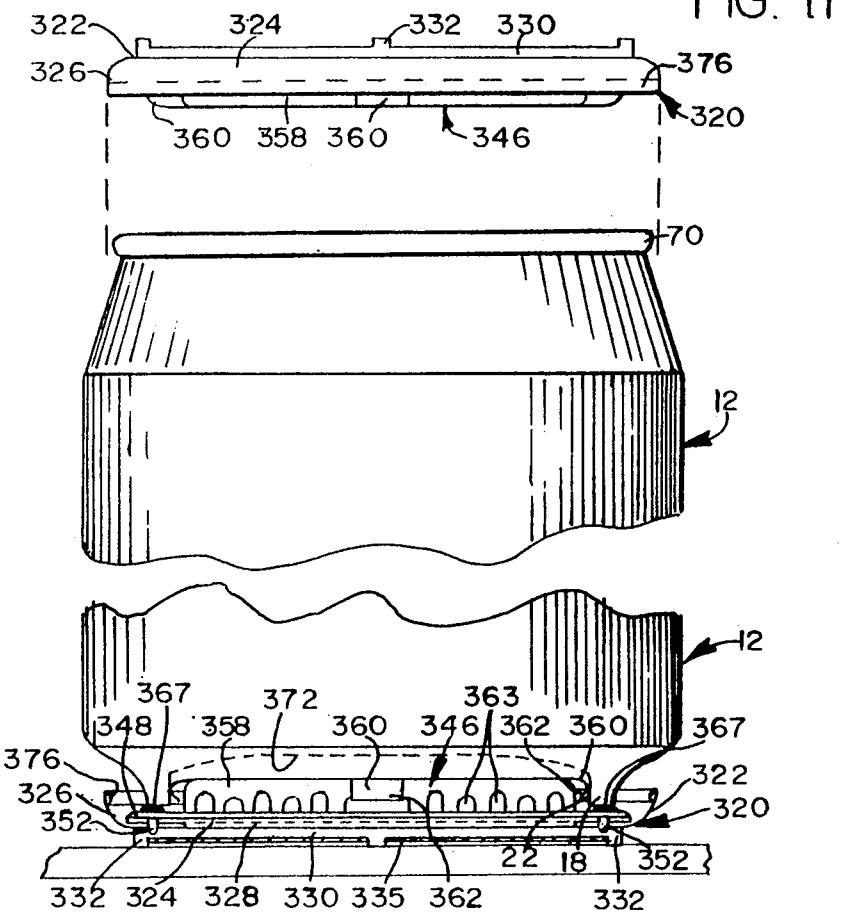
FIG. 11
FIG. 10
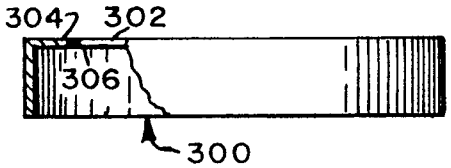
FIG. 9
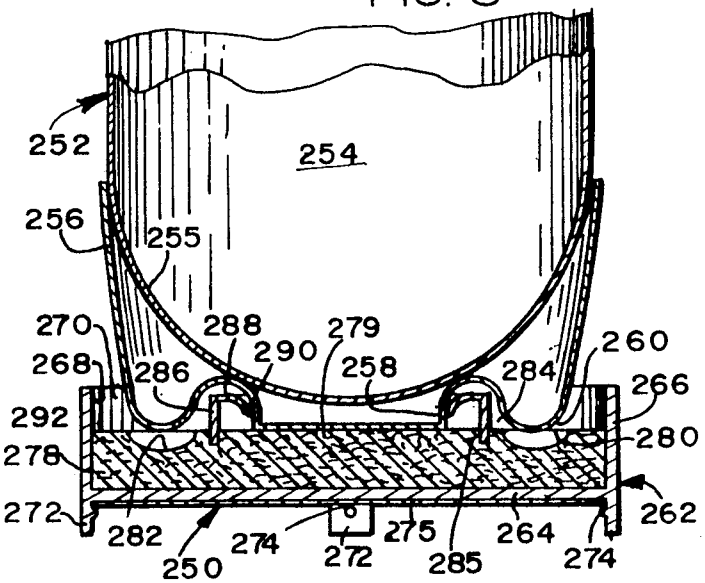
FIG. 8

COASTER

The present invention relates generally to coasters for use with beverage containers and more particularly to a coaster adapted to releasably grip the bottom or foot of a beverage can or container upon placement of the container on the coaster. The coaster includes an absorbent member positioned to absorb and safely hold any moisture present or forming as condensate on and running or dripping from the container while it is coupled to the coaster. The coaster preferably includes structure which is sealably engagable with the upper rim or mouth of the container to form a closure therefor when the coaster is not coupled to the bottom or foot of the container. Advertising and promotional indicia may also be provided on the coaster.

BACKGROUND OF THE INVENTION

A vast majority of soft drinks, fruit juices, beer, wine coolers and other consumable beverages are sold in cans, bottles and other like containers which have been cooled either by refrigeration or immersion in ice cubes or ice water preparatory to being served. Containers cooled by immersion are, of course, "dripping" wet upon being removed from the cooler and opened. And even if the container is carefully dried, condensation will rapidly form on it if there is any significant temperature differential between the cooled container and the ambient air. Particularly if the surrounding air is hot and humid, such condensation will form rapidly and become quite heavy—heavy enough to run off the container onto the hands and clothing of the individual holding the container or onto a table or other piece of furniture on which the container may be placed. Particularly on fine furniture, a moist or dripping can or bottle can cause considerable damage through water stains, veneer separation, raised grain and discoloration of any table cloths or other coverings.

Coasters, of course, have long been used to protect furniture against the damage caused by moisture from cans, bottles and like containers. Should a container be carried from place to place, however, as is often done, it is difficult to remember to carry a coaster along with the container or otherwise avoid putting the container down on unprotected tables, desks and other articles of furniture.

Unfortunately the above described problems have not been eliminated or materially alleviated by the use of mechanical refrigeration. A cold can or bottle, even if initially dry, will quickly collect condensation upon being exposed to warm moist air, as is commonplace throughout much of the year in many parts of the world.

Another problem with the usual beverage can or bottle is in providing for its re-closure should only a portion of its contents be consumed or used. In many cases, the original cover or cap is either not available or not suitable for re-use or, as with present day "pop-top" soft drink or beer cans, the closure is incapable of being re-sealed.

Particularly where the promotion of premium beers and other relatively high priced beverages is intended to appeal to individuals who are highly conscious of health and safety matters, it would be desirable to protect the "drinking" rim of a can against dirt and contamination with an inexpensive removable cover. Because of the cost of providing such removable covers, however, it would be important to be able to promote such covers as dual-purpose, as having a second use to increase their perceived value and thus justify a slightly higher price for "protected" beverage containers.

Further, as the several beverage industries are highly competitive and very dependent upon consumer recognition and selection at the point of purchase, there is a substantial demand both by producers and retailers in those industries for "eye-catching" yet inexpensive and appropriate advertising programs and products.

Over the years, various suggestions have been proposed for solving the problems and meeting the needs discussed hereabove. As far as is known, however, prior to the present invention, no one has been successful in designing, developing and producing a commercially viable dual-purpose product which is inexpensive yet convenient and safe in use, and capable of solving and satisfying the aforesaid problems and needs.

SUMMARY OF THE INVENTION

The present invention provides a new and unique coaster particularly adapted for use with beverage cans and containers in which soft drinks, beer, fruit juices and other like consumable beverages are chilled and served. The coaster is not only uniquely suited to protect clothing and furniture against soiling and damage from the moisture and condensation usually present on containers of chilled beverages, but it is readily adapted for use as a closure to protect the freshness and purity of the contents of such containers after they have been opened. A further feature of the invention is the provision for use of indicia bearing inserts as might be desired to "personalize" a coaster or to use a coaster as an advertising or promotional item.

Included in the coaster is an absorbent member having a seat area positioned to receive the bottom or foot of a can, bottle or other container containing a chilled beverage. The absorbent member preferably is formed of a porous synthetic plastic material which is inert to water, dish-washing detergents, and the various chemicals found in beer, wine, soft drinks, and similar consumable beverages. Sintered particulate polyethylene or polypropylene materials with an average mean pore size in the range of about 15–140 microns and a void volume in the range of about 30–60% have been found satisfactory for use in preparing the absorbent member. Such materials, of course, should be treated with an appropriate wetting agent to make them hydrophilic and thus capable of rapidly absorbing water and aqueous based compounds as might be present or formed as condensate on or run down the side of a container after a drink has been taken therefrom.

The coasters provided by the present invention are readily adapted for use with all types of popular and widely used beverage containers. One such container has a generally cylindrical body portion terminating at its lower end in a substantially flat bottom surface and at its upper end in a reduced diameter neck and mouth. The usual glass beer or soft drink bottle typifies such a container.

Another such container has a generally cylindrical body portion with a recessed lower surface surrounded by a downwardly depending annular foot and an upper end having an upwardly projecting annular rim. The usual aluminum beer or soft drink can represents this type of container.

Another popular container suitable for use with the present coaster concept is the one or two liter plastic soft drink bottle of the type having an attached lower cover member with a centrally disposed short cylindrical foot and spaced outwardly therefrom a concentric annular support ring.

Although the invention is not limited to coasters of a circular shape, such a configuration usually will be found appropriate as a majority of cans, bottles, tumblers, glasses and like containers are generally cylindrical in shape and thus present circular upper and lower ends or surfaces. Accordingly, while the following description and appended drawings generally relate to circular coaster structures, it is to be understood that in its broader aspects this invention clearly is applicable to coasters of rectangular and other shapes if intended for use with non-cylindrical containers.

In a coaster intended for use with a bottle type of container as first described above, the absorbent member should be provided with a centrally located generally flat circular seat of a diameter equal to or preferably somewhat larger than the diameter of the bottom or lower surface of the bottle. Thus, when the bottle is placed on the coaster, the seat of the absorbent member will readily receive and support its lower surface.

One of the primary features of the present invention is to provide means for automatically coupling the coaster to the container with the bottom or foot of the container positioned on the absorbent member. Such positioning insures that moisture and condensate from the container will at all times be safely absorbed and held by the absorbent member no matter how badly the container may "sweat" or how often the coupled container and coaster may be moved from place to place or tilted as sips are taken from the container.

To provide this automatic coupling with the bottle type of container, a generally annular coupling member is fixed to the absorbent member outwardly of its seat. A plurality of semi-resilient contact elements extend inwardly from the coupling member and terminate in distal ends which frictionally grip the outer peripheral wall of the bottle as it is placed on the coaster, such grip being sufficient to couple the coaster onto the lower end of the bottle until it is purposely removed, as when the bottle becomes empty and is manually removed from the coaster for disposal.

As the absorbent member is porous throughout, moisture from the container could, if of a significant volume, permeate to the bottom surface of the absorbent member and perhaps dampen and damage an underlying support such as a table or desk top. To insure against any such damage, the capillary pores or spaces in the absorbent member should at all times be isolated from any underlying support. This isolation may be accomplished in several different ways, as by "sealing" the bottom surface pores using a heated plate or a fast drying spray-on sealant, by attaching an impervious disc to the bottom surface of the absorbent member or by the use of support structure such as legs capable of maintaining the bottom of the absorbent member in a spaced relation with a support surface.

Where expense might be a significant factor, as in producing a large volume of low cost coasters for advertising or promotional purposes, sealing of the bottom pores or attachment of a simple disc would be the least expensive procedure. However, by use of a separate holder for the absorbent member, structure for capping the open end of the container may be provided easily, conveniently and at little extra cost. Such structure may include a flange extending downwardly from the holder, the flange having an internal lip which is sized and shaped to easily snap over and seal around the upper rim or mouth of the container. Irrespective of the use of this "closure" feature, however, the coaster may be provided with indicia intended for personalization or for advertising or promotional purposes.

The second type of container described above comprises a metallic can, generally aluminum, of a type used widely for soft drinks, beer and like beverages. With this type of can, the coaster includes an absorbent member having an annular seat sized to receive the annular foot which depends from the bottom or lower end of the can. Inwardly of the seat is an annular coupling member fixed to the absorbent member and provided with a plurality of semi-resilient contact elements or tabs which radiate outwardly for frictional engagement with the interior periphery of the foot of the can. Thus, as the can is placed on the coaster with its foot on the seat of the absorbent member, the contact elements or tabs will grip the interior periphery of the foot and automatically couple the coaster and can together. As long as the can remains in use, therefore, the coaster will accompany the can and absorb such moisture and condensate as may drip or run from the sides and/or bottom of the can.

The absorbent member may be of a two tier configuration, with a lower tier on which the seat is formed and an upper tier which extends upwardly through the annular coupling member to adjacent its upper edge. This upper tier thus not only increases the total moisture holding capacity of the absorbent member but readily picks up moisture drops from the lower recessed surface of the can.

The absorbent member preferably is mounted in a generally cylindrical holder formed of a semi-resilient plastic and provided with two coaxial sections having oppositely facing open ends. The absorbent member is disposed in one section with its seat facing the open end of that section for the reception of the foot of a can.

Within at least one of the holder sections adjacent its open end is an annular lip. Such lip may comprise a series of two or more stepped annular sealing rings, whereby at least one of such rings generally will be found to sealably engage the upwardly projecting rim of the usual aluminum beverage can should one wish to store a partially full can and preserve the freshness and purity of its remaining contents.

The two sections of the holder are separated from one another by an impervious wall which may be integral with the holder or a separate changeable insert provided with advertising or other indicia. Further, there may be provided a generally flat closure cap having a collar sized to fit both open ends of the holder in order to close the end not coupled to the can. This closure cap may also be provided with advertising or other indicia.

The coaster intended for use with the usual one or two liter bottle comprises a generally circular absorbent member having a centrally located circular seat sized to receive the short cylindrical foot which extends downwardly from the center section of the cover attached to the lower end of the bottle. The absorbent member also has a secondary seat concentric with but spaced outwardly from the central seat. This secondary seat is sized to receive the annular outer support ring on the bottom cover of the bottle.

Fixed to that portion of the absorbent member located between the two seat areas is a coupling member having a plurality of inwardly extending contact elements or tabs which are positioned to releasable grip the cylindrical foot of the bottle as the bottle is placed on the coaster. Thus, as with the other embodiments described above, the coaster of this embodiment will remain coupled to the beverage bottle and absorb any moisture therefrom as it may be moved from place to place. Also, as with the earlier described embodiments, this type of coaster includes means to prevent any transfer of moisture from the absorbent member to any support surface on which it may be placed. It may also provide structure for re-capping the bottle and for the display of indicia.

Throughout the foregoing and following description, it will be understood that as related to a container, the term "upper", "top" or "upwardly" has reference to that end of a can, bottle or other container which normally is opened or uncapped to gain access to its contents, even should the container be oriented during use so that such end is no longer uppermost. The term "lower", "bottom" or "downwardly" has reference to the other end of the container—the end which is not normally opened and on which the container usually is placed after being opened. As related to the coaster, the term "upper", "top" or "upwardly" has reference to that surface or end of the coaster which is intended to be coupled to the lower or bottom end of a container even should that surface of the coaster be inverted as while being used to re-seal or close an opened container. The term "lower", "bottom" or "downwardly" has reference to the other surface of the coaster. The terms "inwardly" and "outwardly" have reference to a direction toward or away from the center point or transverse axis of the element referred to.

OBJECTS OF THE INVENTION

It is a principal object of this invention to provide an improved coaster.

It is a further object of this invention to provide an improved coaster adapted particularly for use with cans, bottles and other containers holding beverages normally served cold.

Another object of this invention is the provision of a coaster with an absorbent member positioned for safely absorbing moisture and condensate from a cold beverage can, bottle or other container.

A still further objective of this invention is to provide structure for automatically coupling a coaster to a can, bottle or other like container upon placement of the container on the coaster whereby the coaster is movable with the container.

Yet another abject of this invention is the provision of a coaster capable of serving both to collect moisture from the bottom of a can or container and as a closure for that container after it has been opened or uncapped.

Another objective of this invention is the provision of a coaster capable of being provided with indicia for personalization or advertising purposes.

Yet a further object of this invention is to provide a coaster which can be adapted readily for use with various types and sizes of cans, bottles and other containers holding beverages which are normally served cold.

A still further objective of this invention is the provision of an improved coaster which is simple, inexpensive and durable in construction yet highly efficient and convenient is use, Yet an additional object of this invention is the provision of a combination coaster and closure device suitable for use both in private homes and commercial establishments.

The above and other objects, features and advantages of the present invention will be apparent from the following description when read in association with the accompanying drawings.

BRIEF DESCRIPTION OF THE DRAWINGS

FIG. 1 is a cross sectional view of a coaster according to the present invention, the coaster being coupled to the lower end or foot of a metallic beverage container or can, there being a removable closure cap attached to the lower section of the coaster.

FIG. 2 is a cross sectional view of the coaster of FIG. 1, as sealably attached to the upper rim of the container, with the closure cap being attached to the upper section of the coaster.

FIG. 3 is an exploded prospective view of the coaster of FIG. 1 but without the closure cap or indicia disc.

FIG. 8 is a cross sectional view of still another embodiment of a coaster according to the present invention as coupled to the foot of a 2-liter soft drink bottle.

FIG. 9 is a front elevational view, partially in cross section, of a modified form of the coupling member shown in FIG. 8.

FIG. 10 is a cross sectional view of yet a further embodiment of a coaster according to the present invention as coupled to the foot of a metallic beverage can.

FIG. 11 is a cross sectional view of the embodiment of FIG. 9 as positioned for attachment to the upper rim of an opened beverage container.

DESCRIPTION OF THE PREFERRED EMBODIMENT

Figure 7:
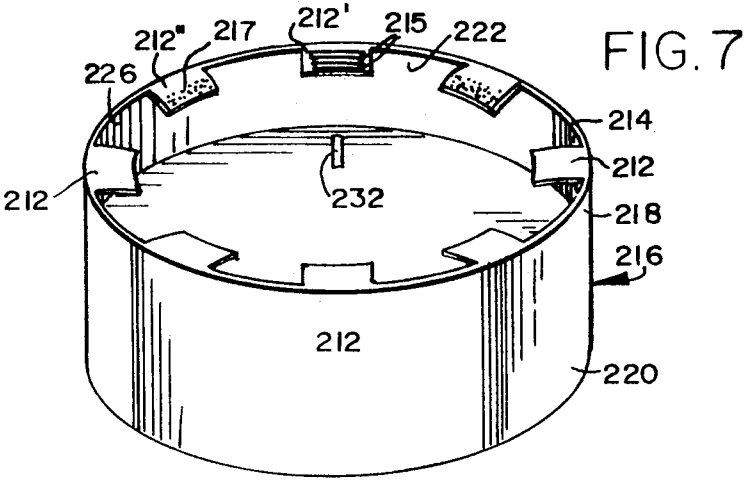
FIG. 7 is a prospective view of the coaster of FIG. 6.

Continuing now with a more detailed description of the preferred embodiment of the present invention, reference is first made to FIGS. 1 and 2 of the drawings showing a coaster 10 adapted for use with an aluminum beverage container or can 12 of the type used widely with soft drinks, beer and other beverages which are normally chilled before being served and consumed.

As will be seen from FIGS. 1 and 2, the body 14 of the can 12 is generally cylindrical and formed at its lower end with a recessed bottom surface 16 surrounded by a downwardly depending annular foot 18. The outer surface 20 of foot 18 is generally conical and tapers inwardly from the body portion 14. The inner surface 22 of foot 18 extends downwardly from the periphery of the recessed bottom surface 16 at a slight outward angle to meet the outer surface 20 in a somewhat rounded annular apex. Inner surface 22 thus forms an annular peripheral surface internally of foot 18 facing inwardly toward the center of the can 12.

The container 12 depicted in FIG. 1 is typical of practically all aluminum beverage cans currently in use, including the recessed lower surface 16 and downwardly depending foot 18 having internally thereof the inwardly facing annular peripheral surface 22. The diameter and height of the peripheral surface 22 varies somewhat from one brand of can to another, but in practically all cases the height runs between about 0.1875" and 0.2187" and the inside diameter, at its smallest point, runs between about 1.8125" and 1.875". As will be pointed out hereafter, a coaster according to the present invention will readily accommodate dimensional variations as between brands of cans falling into ranges of the foregoing magnitude.

Referring to FIGS. 1 and 3, the coaster 10 includes an absorbent member 24 which in the present embodiment is generally circular in configuration. The absorbent member may be made from two separate discs stamped from a flat sheet of an appropriate porous plastic material and attached together as by an adhesive or a plastic or stainless rivet. Preferably, though, the absorbent member is formed as a finished component in a suitably shaped die.

One material which has been found to be particularly suitable for use in preparing the absorbent member is produced commercially by Porex Technologies of Fairburn, Ga., and sold in sheet form under the designations x-4899/x-4741/x-4894, depending upon the thickness ordered. This material is formed by a sintering process from particulate polyethylene to provide a relatively strong but somewhat resilient porous structure having a mean micron pore size ranging between about 40–100 microns and a void volume ranging between about 30–60%. The material is treated to make it hydrophilic and thus capable of readily and rapidly absorbing water and any of the usual aqueous based beverages.

As indicated above, while the absorbent member 24 may be assembled from two separate discs, preferably it is formed as a finished component in a suitably shaped die, as are other porous plastic components such as tips for marking pens.

As will be noted from FIG. 1, the lower circular portion 26 of the absorbent member 24 is larger in diameter than the annular foot 18 of can 12 and, thus, will provide an annular seat 28 sized to receive foot 18 as the can 12 is placed on coaster 10. The upper circular portion 30 of absorbent member 24 is smaller in diameter than the annular peripheral surface 22 of foot 18 and projects upwardly to a position within the foot. Preferably, though, circular portion 30 does not project far enough into foot 18 to contact the bottom recessed surface 16 of can 12 as such contact might interfere with seating of foot 18 on seat 28. It is desirable to maintain such direct seating to foster immediate absorption by absorbent member 24 of any moisture which is initially on can 12 from immersion in ice or ice water and/or which subsequently forms on the can as condensate. However, the absorbent member 24 will still function satisfactorily should for any reason a slight space exist between foot 18 and some or even all of the adjacent seat 28 as moisture will quickly form a "bead" spanning such space.

One or more semi-circular radially disposed grooves or vents 32 are formed in lower circular portion 26 through seat 28 as a means for providing free communication between the atmosphere and the otherwise closed space 33 formed within the foot 18 upon its contact with seat 28. Particularly should the foot 18 initially be wet and fill the pores or capillary spaces of the absorbent member 24 in the circular area of the annular seat 28, air trapped within space 33 might otherwise impede the expulsion of air from the pores opening into space 33 as they are filled with moisture moving inwardly through the pores from the seat area. Further, the presence of the vents 32 will permit the more rapid evaporation of moisture from absorbent member 24 should the can 12 happen to be left coupled to the coaster for a period of time after its use.

The vents 32 should be wide and deep enough through the seat 28 to assure against the creation of a capillary force strong enough the keep the vents full of moisture. For instance, vents in the range of 0.0625" to 0.0937" in width and 0.0625" in depth should provide adequate ventilation.

Means for automatically coupling can 12 to coaster 10 are provided in the present embodiment by an annular coupling member 34 molded of a semi-resilient form retaining plastic material and mounted on the absorbent member 24 inwardly of seat 28 and around the periphery of the upper circular portion 30. The inside diameter of the coupling member 34 preferably is somewhat larger than the outside diameter of upper circular portion 30 to provide some latitude for radial flexure of the coupling member for a purpose to be described hereinafter. As the height of the inner peripheral surface 22 of foot 18 normally ranges between 0.1875" and 0.2187", the coupling member 34 preferable should run no more than about 0.1875" in height to avoid any direct contact with the recessed bottom surface 16 of can 12. Although other arrangements may be used to fix the coupling member 34 to the absorbent member 24, in the instant embodiment the coupling member 34 has at its lower end a narrow flange 36 which extends inwardly into an appropriately sized groove 38 formed at the base of upper circular portion 30. Being molded of a semi-resilient material, the coupling member 34 and flange 36 will flex and expand enough to permit flange 36 to slide over the periphery of upper circular portion 30 and snap into groove 38, As best shown in FIG. 3, a plurality of semi-resilient contact elements 40 are spaced evenly around the upper edge of coupling member 34. The contact elements 40 extend radially outwardly of and curve downwardly from the upper edge of coupling member 34, and terminate in distal ends 42 which collectively define a circle which in diameter is several thousandths of an inch larger than the diameter of the largest annular peripheral surface 22 to be used with the coaster. For example, if the largest diameter of surface 22 is 1.875", the distal ends 42 should lie on a circle of about 1.9375" in diameter. Thus, as the foot 18 of can 12 approaches and is seated on annular seat 28 of absorbent member 24, the distal ends 42 of contact elements 40 are first engaged by the lower end of peripheral surface 22 and then slide upwardly on surface 22 to a position where a secure frictional engagement is provided. As the distal ends 42 slide upwardly over surface 22, the contact elements 40 are biased inwardly and thus generate the outward spring-like pressure needed to maintain the secure frictional engagement between wall 22 and distal ends 42 as is necessary to couple the coaster 10 to can 12.

Should a can 12 having a foot 18 with a peripheral surface 22 of minimum diameter of about 1.8125" be coupled to coaster 10, the distal end 42 of each contact element 40 will be forced to flex radially a total of about 0.0625". In such a case, the upper portion of the coupling member 34 will flex inwardly and relieve some of the pressure on the contact elements 40 if the coupling member 34 is not too thick and/or not tightly engaged with the adjacent outer periphery of the upper circular portion 30. Dimensionally, the thickness of the coupling member 34 and integral contact elements 40 will depend somewhat on the resiliency of the material from which they are molded. Generally speaking, the stiffer the material, the thinner the coupling member and contact elements should be made. In the present embodiment, for example, the coupling member 34 and contact elements are formed of a low density polyethylene with a wall thickness of about 0.0468" and 0.0312" respectively.

Although this embodiment is not limited to a coupling member 34 with a specific number of contact elements, it has been found that a very smooth yet secure coupling action will be realized using a range of 8 to 16 contact elements 40 spaced around the upper edge of the coupling member 34. As will be understood, as the number of contact elements 40 are increased, the width thereof and the space therebetween preferably should be reduced. Otherwise, the pressure needed to press the can 12 down onto the coaster 10 for coupling purposes could become somewhat excessive. For instance, with eight contact elements 40, each element preferably should be about 0.2812" wide. Upon increasing the number of contact elements 40 to 10, 12 or 14/16, the width preferably should be reduced to about 0.250", 0.2187" and 0.1875", respectively. Further, to avoid stiffening the contact elements 40 excessively at their points of merger 44 with the upper edge of coupling member 34, the intersection preferably comprises a square corner rather than a rounded web.

The absorbent member 24 and attached coupling member 34 are shown in the present embodiment as being mounted in a generally cylindrical holder 46 preferably molded from a semi-resilient plastic such as polyethylene. The holder 46 includes two coaxial sections—a first or upper section 48 and a second or lower flange section 50. Internally, section 48 defines a first internal bore 52 terminating in a first or upper open end 54, and flange section 50 defines a second internal bore 56 terminating in a second or lower open end 60, As wail be noted from FIGS. 1, 2 and 3, the upper section 48 of holder 46 may be somewhat larger in diameter than lower section 50, thus providing an internal offset or shoulder 62 facing toward first open end 54.

The absorbent member 24 and attached coupling member 34 are snugly fit within upper bore 52 against the internal offset provided by shoulder 62. The absorbent member 24 is positioned with its annular seat 28 facing open upper end 54 whereby the annular foot 18 of can 12 is readily engaged with the absorbent member 24 and coupling member 34 through that open end.

For a purpose to be described in more detail hereinafter, the two bores of the holder 46 should be isolated from each other. Such isolation preferably is accomplished by wall 64 which is an extension of the offset formed by shoulder 62 and which is non-pervious to liquids.

Although the coaster 10 as described hereabove represents a unique, novel and useful advance in the art, its usefulness can be even further enhanced by the addition within bore 56 adjacent its open end 60 of an annular lip 68.

Referring now to FIG. 2, it will be seen that the coaster embodiment described hereabove has been placed on the upper end of can 12 with lip 68 in engagement with upwardly projecting annular rim 70 formed around the upper end of the can 12 at the time the outer periphery of the top or closure 72 is rolled or otherwise tightly closed over the upper edge of the can body 14. The diameter of lip 68 is such as to snugly engage rim 70 and form therewith a liquid tight seal. And since the wall 64 is impervious, the upper end of can 12 is thus sealed from the atmosphere and any beverage within the can will be protected against contamination and loss of freshness. Also, of course, should the can be tipped over, spillage of beverage will be prevented. Further, the rim 70 of the can will be protected against dirt and contamination and thus remain clean—an important feature should one wish to drink directly from a previously opened container after a period of storage.

The annular lip 68 may be comprised of a stepped series of concentric annular sealing surfaces each being tapered and sized to slide over a different size can rim 70. Thus, just as the coupling means (coupling member 34 and contact elements 40) is able to accommodate diametrical differences in the inner periphery 22 of the foot 18 of the can 12, the sealing lip 68 is able to accommodate diametrical differences in the rim 70.

A flat indicia disc 74 is disposed within the second bore 56 of holder 46 proximate wall 64. Preferably this disc is relatively thin and flexible, and held in position by a series of small projections 76 spaced around the inner surface of second bore 56 close to wall 64. The disc, which may be personalized for home use or provided with a commercial message or logo for advertising or promotional purposes, is easily "snapped" into place. The material of disc 74 and any ink or paint used in printing thereon obviously should be inert and not adversely affected by any components of soft drinks, beer, or the like.

A closure cap 78 is provided for attachment to holder 46 to close second open end 58 while coaster 10 is coupled to the foot 18 of can 12, and to close first open end 54 while the coaster is attached to rim 70. The closure cap 78 includes a relatively flat body portion 80 with an upturned edge., and extending perpendicularly therefrom an annular collar 82. As clearly indicated by FIGS. 1 and 2 of the drawing, the inside diameter of collar 82 is dimensioned to frictionally fit over the outside surface of the lower section 50 of holder 46, and the outside diameter is dimensioned to frictionally fit within the first open end 54 of holder 46. Thus, whether coaster 10 is coupled to the top or bottom of can 12, the closure cap 78 in useful to close and thus protect from dirt and contamination the unused bore of holder 46. As will be understood, the outside flat surface of closure cap 78 is ideally suited for the reception of indicia for personalization or commercial advertising purposes.

From the preceding description, it is believed that the function of coaster 10 is clear. After the can 12 has been removed from a container of ice or iced water or from a refrigerator and opened, it should first be pressed onto the coaster 10, with the annular foot 18 positioned on annular seat 28. As the can and coaster are being coupled together, the distal ends 42 of contact elements 40 are engaged and biased inwardly by inner peripheral surface 22 of the foot 18 of can 12. Because of the semi-resilient form retention nature of the material of coupling member 34 and contact elements 40, the elements 40 will press against surface 22 with sufficient force to couple the coaster 10 to the can 12 so that the can and coaster are movable as a unit until such time as they are manually separated. As the can and coaster are first coupled, the absorbent member will rapidly absorb any moisture which is initially on the bottom of the can 12, and thereafter it absorbs any moisture which may form as condensate and run down the sides of the can. As such moisture is absorbed in the seat area 28, it will rapidly permeate throughout the interconnected capillary spaces or pores of the absorbent member 24. Air from the pores opening into the space 33 within the foot 18 will exhaust easily through vents 32 as the pores are filled with moisture. Such vents 32 also permit more rapid evaporation of moisture from the absorbent member 24 than would otherwise occur should the can 12 be left coupled to the coaster for a long period after use.

Should a portion of the contents of can 12 be left, such contents can be kept fresh and protected against contamination by removing the coaster 10 from the bottom of the can 12 and pressing the second open end 60 of lower section 50 of the holder 46 over the rim 70 of the can. Lip 68 within second bore 56 will sealably engage the rim 70 and thus re-close the can. As the coaster 10 is moved between the ends of the can 12, the closure cap 78 should be shifted from the lower section 50 of holder 46 to its upper section 48. In addition to its protective nature, closure cap 78, when assembled with lower section 50 as shown in FIG. 1, will improve the stability of can 12 against tipping as the cap is larger in diameter than annular foot 18.

It should be pointed out that for convenience in stacking a set of coasters 10 for storage, the lower section 50 of one coaster will nest within the first open end 54 of upper section 48 of another coaster. Thus, a set of coasters can be safely stacked and stored without danger of inadvertent sliding and tipping. Also, it should be mentioned that the coaster 10, including the assembled absorbent member 24 and coupling member 34, are "dishwasher safe" and thus can be washed after each use to preserve its cleanliness.

DESCRIPTION OF OTHER EMBODIMENTS

Figure 4:
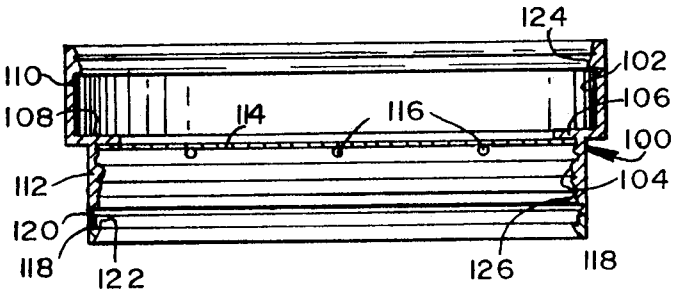
FIG. 4 is a cross sectional view of the holder of the coaster of FIG. 1, as provided with a break-away signal ring and a series of annular sealing rings within the open ends of the holder.

Turning now to other embodiments of the invention, attention is first called to FIG. 4, showing a holder 100 similar to holder 46 of the embodiment of FIGS. 1-3. The absorbent member and coupling means are not shown in FIG. 4 as such components preferably are substantially the same in structure, function and effect as the absorbent member 24 and coupling member 34 of the FIGS. 1-3 embodiment.

Holder 100 differs from holder 46 in three primary respects. First, it does not have a continuous wall between the first bore 102 and second bore 104. Rather, it includes a relatively narrow annular flange 106 extending inwardly between bores 102 and 104 from the offset formed by shoulder 108 at the junction of upper section 110 and lower section 112 of holder 100. Pressed against the lower surface of this annular flange 106 is an impervious indicia disc 114 held in position by a plurality of small projections 116 spaced around bore 104 close to the flange 106. The diameter of indicia disc 114 is such that its outer periphery makes sealing engagement with the proximate annular surface of second bore 104. Particularly before insertion of an absorbent member/coupling member assembly into first bore 102, the holder 100 can be flexed and stretched readily to permit insertion and/or replacement of disc 114.

A second difference between this embodiment and that of FIGS. 1-3 is the provision of a break-away signal band 118 connected to the lower edge of the lower section 112 by a plurality of thin relatively fragile connector segments 120. The inner surface of the signal band is provided with a reverse "barb" type of upper edge 122 which after once being pressed over the rim 70 of can 12 will catch on and not slide over the rim 70 in the reverse direction. Thus, the signal band 118 will break away from the holder 100 and remain on the can 12 as the holder is removed from the upper end of a previously opened can. So long as the holder 100 and signal band are intact, therefore, one is assured that the contents of the can have not been adulterated.

The third difference resides in the use within the first bore 102 and second bore 104 of sealing lips 124 and 126, each of which comprises a stepped series of two concentric annular sealing surfaces of varying diameters. Thus, the one coaster has the capability of forming a closure for cans wherein there are various diametrical differences in the upper rim 70.

Figure 5:
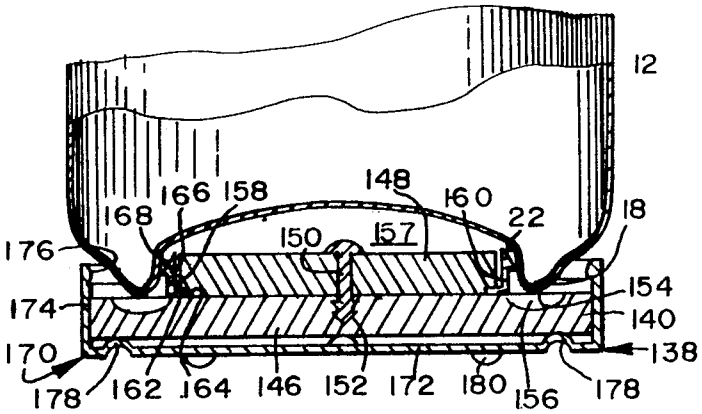
FIG. 5 is a cross sectional view of another embodiment of a coaster as coupled to the foot of a metallic beverage can according to the present invention.
Figure 13:
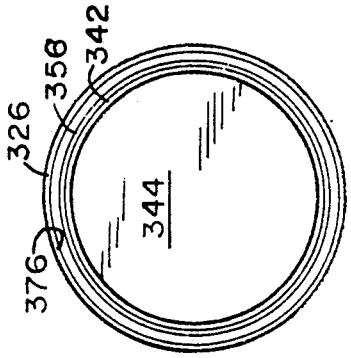
FIG. 13 is a top plan view on a reduced scale of the base portion of the embodiment of FIG. 9.
Figure 14:
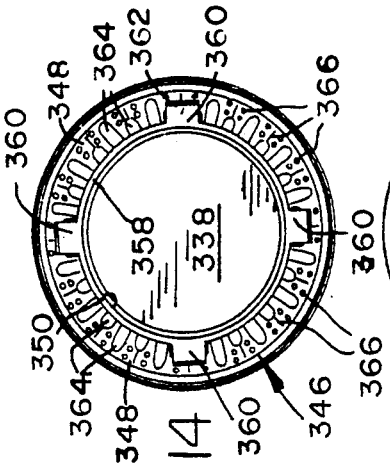
FIG. 14 is a top plan view on a reduced scale of the coupling member of the embodiment of FIG. 9.
Figure 15:
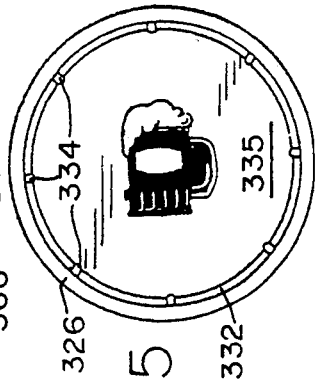
FIG. 15 is a bottom plan view of the embodiment of FIG. 9, showing advertising indicia as carried on a removable disc.

The embodiment of FIG. 5 is a very low cost version of a coaster 138 according to the present invention. As such, it is particularly suitable for production in large quantities as a give-away for advertising and promotional purposes. In this embodiment, absorbent member 140 basically is the same in structure and function as absorbent member 24 of the embodiment of FIGS. 1-3 except that it is composed of two parts rather than one integral component. Such parts preferable are stamped or cut from a flat sheet of porous plastic material of the nature described heretofore, and include a lower circular portion 146 and an upper circular portion 148. While various other methods may be used to assemble circular portions 146 and 148, in the present embodiment they are fastened together by a headed drive-in fastener 150 of a type having reverse angled barbs 152 to resist pull-out and thus prevent inadvertent disassembly.

As with the FIGS. 1-3 embodiment, lower circular portion 146 includes an annular seat 154 sized to receive the annular foot 18 of can 12. A plurality of radially disposed vents or channels 156 span seat 154 to provide for free communication between the atmosphere and the space 157 within annular foot 18 after the can 12 has been coupled to the coaster 138 with foot 18 positioned on seat 154. As explained earlier, such venting is provided not only to insure the free movement of air from the pores or capillary spaces of the absorbent member 140 which open into space 157 as they become filled with moisture and condensate from can 12 but to foster subsequent dry out of the absorbent member.

Means for coupling can 12 to coaster 138 are comprised of a plurality of radially displacable contact elements 158 spaced around and extending upwardly from the outer periphery of an annular coupling member 160. The annular coupling member 160 and integral contact elements 158 preferably are molded as an integral unit of a semi-resilient form-retaining plastic, such as a low density polyethylene, and positioned concentric with and inwardly of seat area 154. Coupling member 160 includes an inwardly projecting flange 162 disposed in a recess 164 in the lower outer periphery of upper circular portion 148. As will be obvious, the coupling member 160 should be positioned on upper portion 148 with flange 162 in recess 164 before the circular portions 146 and 148 are assembled with fastener 150.

The upper distal ends 166 of contact elements 158 terminate in angled surfaces which taper outwardly and downwardly to provide what might best be described as cam surfaces 168 positioned for sliding engagement with inner peripheral surface 22 of foot 18 as foot 18 approaches seat area 154 during coupling of coaster 138 to can 12. The contact elements 158 normally should be positioned so that prior to any contact with peripheral wall 22 the upper end of surfaces 168 are positioned in a circular pattern of a diameter slightly smaller than the diameter of peripheral wall 22 whereas the lower end of surfaces 168 are positioned in a circular pattern on a diameter somewhat greater than that of said peripheral wall 22. Thus, the contact elements 158 will be biased inwardly by the interaction of surfaces 168 and wall 22 to create a frictional fit between the wall 22 and the distal ends 166.

While the number of contact elements 158 provided on coupling member 160 may vary, it is preferred that between 8 and 16 contact elements are used. In the instant embodiment, they should measure about 0.1875" in height, about 0.0312" in thickness and between about 0.2187" and 0.1875" in width. It will be understood, however, that the foregoing dimensions may require adjustment depending upon the specific material used in molding the coupling member 160, the dimensions of the contact elements 158 and other factors within the control of the manufacturer.

The lower circular portion 146 is pressed or otherwise retained in a cup-like holder 170. The holder 170 includes a circular base 172 terminating on its outer periphery in an upwardly extending side wall 174 surrounding the outer periphery of lower circular portion 146. The side wall 174 preferably is of such height and diameter that an annular lip 176 can be provided internally of its upper edge for sealing the rim 70 of can 12 after the can has been opened.

Two series of projections 178 and 180 are spaced around base 172 inwardly of its periphery. The first series includes at least three projections 178 which extend upwardly to support the bottom surface of absorbent member 140 in a spaced relation with the base 172. The second series consists of at least three projections 180 which extend downwardly from base 172. These projections serve as feet to support the coaster in a spaced relation with the top of whatever desk, table or other piece of furniture on which the coupled can 12 and coaster 140 may be placed. Thus, even should the absorbent member become relatively saturated with cold moisture and condensate from the can 12, the air space between the bottom of absorbent member 140 and inner surface of base 172 should substantially remove any likelihood of any condensate forming on the bottom of the base and dripping or transferring to any surface on which the coupled can 12 and coaster 138 may be placed.

The bottom surface and side wall 174 of base 172 may be printed with indicia should it be desired to use the coasters 140 for advertising or promotional purposes.

Figure 6:
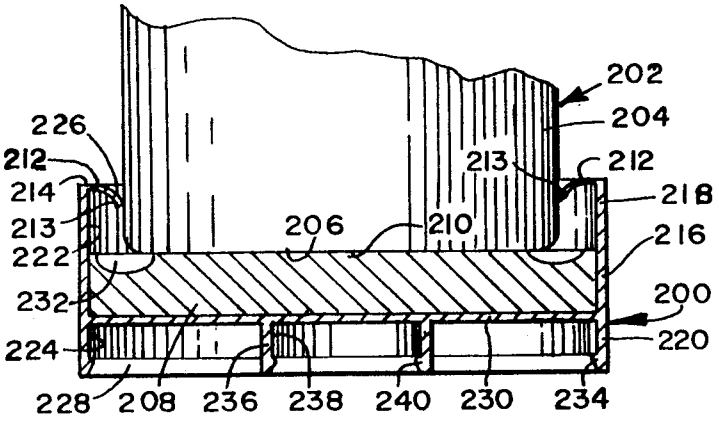
FIG. 6 is a cross sectional view of yet another embodiment of a coaster according to the present invention as coupled to the lower end of a beverage bottle.

The embodiment of FIGS. 6 and 7 comprises a coaster 200 which is particularly suitable for use with containers such as the bottles used widely for packaging and serving soft drinks, fruit juices, beer, wine coolers, and other cold beverages. As indicated earlier in this specification, a bottle 202 of this nature generally has a cylindrical body section 204 which terminates on its lower end in a relatively flat lower surface 206 and on its upper end in a reduced neck and mouth (not shown).

The coaster 200 includes a circular absorbent member 208 having on its upper surface a circular seat area 210 of a diameter slightly larger than the diameter of the bottom surface 206 of bottle 202. Absorbent member 208 may be a molded component or it may be stamped or cut from a sheet of appropriate hydrophilic porous material having interconnected pores or capillary spaces sized to rapidly absorb and safely retain any moisture which may be present on bottle 202 when it is placed on coaster 200 or which may subsequently condense on and run down the sides of the bottle.

As with other embodiments described earlier, this embodiment provides means for automatically coupling coaster 200 to bottle 202 as the bottle is placed on the coaster. Such means are comprised of a plurality of radially resilient contact elements 212 which project inwardly and curve downwardly from the top edge 214 of cylindrical coupling member 216. The distal ends 213 of contact elements 212 terminate in a circular pattern of a diameter which normally is somewhat smaller than the diameter of the body portion 204 of bottle 202 whereby, as the bottle 202 is placed on coaster 200, the contact elements 212 are biased outwardly to frictionally engage the outer peripheral surface of the body 204 of bottle 202 adjacent its lower end.

Should it be desired to increase the coefficient of friction between the distal ends 213 of contact elements 212 and the peripheral surface of the body 204 of bottle 202, such an increase may be accomplished by any of several different methods. One such method is indicated in FIG. 7, wherein the outer face of distal end 213 of contact member 212' is provided with discontinuities comprising two transversely positioned splines 215. Another method of increasing the friction is indicated by contact member 212" wherein the outer face of distal end 213 carries a multiplicity of small abrasive particles 217 either impressed into or projecting through the outer face or adhered thereto. Also, the outer face could be molded with or chemically or mechanically treated or etched to provide a roughened or pebble-grained surface capable of providing increased friction.

As will be seen from the drawings, coupling member 216 also serves as the holder of the coaster 200. The member 216 includes an upper section 218 and a lower section 220 defining first and second bores 222 and 224 and first and second open ends 226 and 228, respectively. An impervious wall 230 separates and isolates bores 222 and 224 one from the other.

Absorbent member 208 is positioned in first bore 222 against wall 230 whereby seat area 210 faces outwardly of first open end 226 in position to receive the bottom surface 206 of bottle 202 and absorb any moisture which may be present thereon or any condensate which subsequently forms on and runs down the sides of bottle 202.

Although the flat bottom surface 206 of the usual beverage bottle 202 will not result in the entrapment of air under surface 206, it is desirable to include in absorbent member 208 a plurality of radially disposed vents 232 spanning the annular area which would comprise a seat should a container having a downwardly depending annular foot be placed on coaster 200. For example, a container such as can 12 or a plastic tumbler with a recessed bottom surface, if placed on coaster 200, would create a closed space within the foot in the absence of vents 232.

Within second bore 224 adjacent second open end 228, the lip 234 is shaped and sized to sealably engage the upper end of certain containers, such as glasses or tumblers, which may be used with coaster 200. In addition, the coaster 200 is provided within second bore 224, depending from wall 230, a centrally disposed cylindrical seal section 236 having an internal bore 238 with an annular lip 240 sized and shaped to sealably engage the relatively small diameter mouth (not shown) of the usual soft drink or beer bottle. Thus, coaster 200 is suitable for use in closing the upper open end of a bottle or other container, whether having a small or large mouth.

Turning now to the embodiment of FIG. 8, there is shown a coaster 250 adapted particularly for use with, but not limited to, the one or two liter type of container 252 used widely with soft drinks. This type of container consists of a bottle portion 254 with a generally hemispherical lower end 255 having a cover member 256 adhered thereto. The cover member includes a centrally located downwardly depending generally cylindrical foot 258 and spaced outwardly therefrom a concentric annular support ring 260.

The coaster 250 is shown as including a holder 262 preferably molded of an inert semi-resilient form retaining plastic such as polyethylene or polypropylene. The holder 262 includes a generally circular base 264 having formed around its outer periphery an upwardly extending cylindrical wall 266 defining an internal bore 268 and terminating in an upwardly open end 270. A plurality of support legs 272 are spaced around and depend downwardly from base 264 for use in supporting the coaster 250 in a spaced relation with whatever deck, table or other item on which the coaster may be placed.

Extending inwardly from the inner surface of each leg 272 is a small protrusion 274 spaced a short distance below the bottom surface of base 264. Should it be desired to personalize the coaster or adapt it for advertising or promotional purposes a circular indicia disc 275 may be assembled with the coaster by snapping its outer edge over protrusions 274 into the small space between the protrusions and the bottom of base 264. The protrusions then act to hold the indicia disc 275 against the bottom of base 264.

Disposed within bore 268 is a generally flat absorbent member 278 comprised of an hydrophilic porous material of the general type described in detail earlier in this specification. The absorbent member includes a centrally disposed seat area 279 sized to receive foot 258 and spaced outwardly thereof an annular secondary seat 280 sized to receive support ring 260 of cover 256. Spanning secondary seat 280 are a plurality of radially disposed vent channels 282 to insure free communication between the atmosphere and the space 284 within annular support ring upon placement of container 252 on coaster 250 with support ring 260 positioned on secondary seat 280.

Means for coupling the coaster 250 to bottle 252 is provided by annular coupling member 286 molded from a semi-resilient form retaining material such as polyethylene, polypropylene or other plastic or rubber material. Although other arrangements may be used to attach coupling member 286 to absorbent member 278, in the present embodiment the lower end of the coupling member 286 is adhesively secured in circular groove 285.

Integral with and spaced around the upper edge of coupling member 286 are a plurality of inwardly extending downwardly curved contact elements or tabs 288 which terminate in distal ends 290. Distal ends 290 are positioned to form a circular opening of a diameter somewhat less than that of central foot 258. For example if the peripheral surface of the foot measures 1.75" in diameter, the circle formed by distal ends 290 may conveniently measure about 1.625" in diameter. Thus, each contact element will flex approximately 0.0625" upon reception of foot 258 as the bottle 252 is placed on the coaster 250.

It will be understood, of course, that upon placement of the bottle on the coaster, any moisture initially on the bottle or subsequently forming thereon as condensate will be absorbed and safely retained by absorbent member 278 as such moisture runs down the side of the bottle and over or through the cover member 256. In this connection, it is to be noted that the usual cover member 256 has several drainage holes 292 spaced around the lower surface of support ring 260, so any moisture which may run down the inside surface of cover member 256 will drain readily through holes 292 into absorbent member 278 in the area of the secondary seat 280.

FIG. 9 shows a modified coupling member 300 suitable for use in the FIG. 8 embodiment. The modified coupling member is generally cylindrical in configuration, the lower edge of which is dimensioned to fit within circular groove 285. Extending inwardly from the upper edge 302 of coupling member 300 and integral therewith is an annular flange 304. The flange tapers to a relatively thin inner edge 306 which defines a circular opening of a diameter measuring somewhat less than the diameter of the outer peripheral surface of foot 258. Although this range may vary with the characteristics of the material used in molding coupling member 300, in using a low density polyethylene the diameter of the inner edge 306 of flange 304 preferably should run about 0.0625" to 0.125" smaller than the diameter of the foot 258. The tapered inner edge 306 has been found to be resilient and flexible enough to stretch over and securely grip the peripheral wall of the foot 258 as the bottle 252 is assembled with coaster 250.

Referring now to the embodiment of FIGS. 10–15, there is provided a coaster 320 shown in FIG. 10 as coupled to a metallic beverage container or can 12 of the type described heretofore in this specification.

Figure 12:
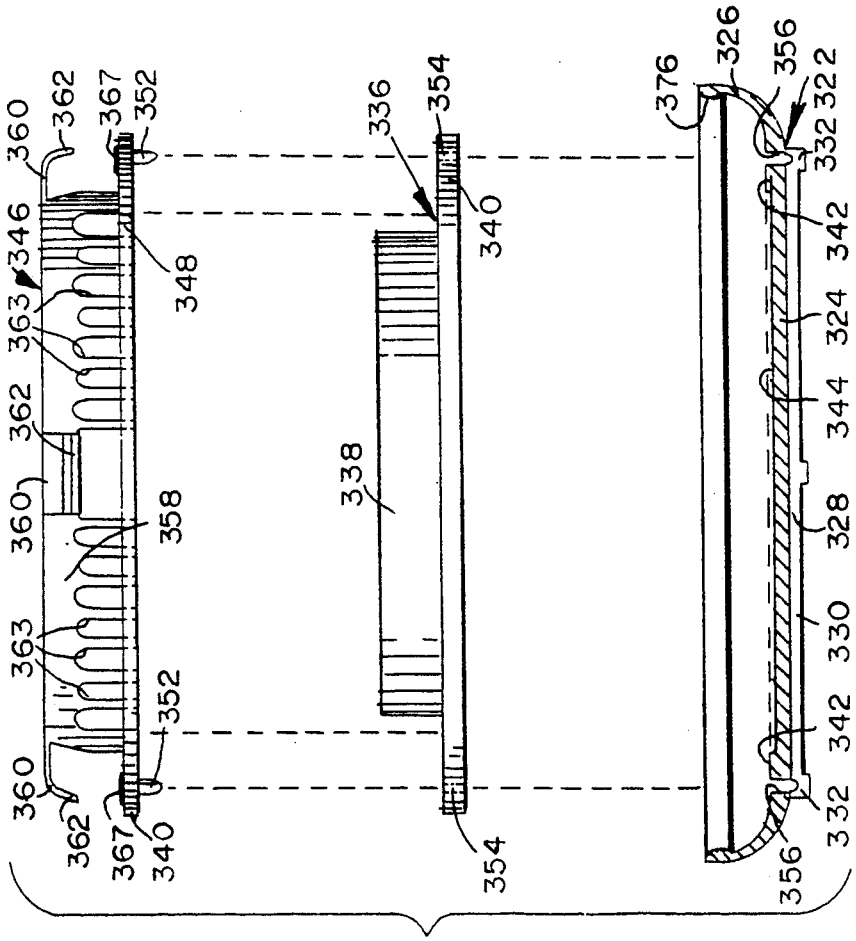
FIG. 12 is an exploded view of the components of the embodiment of FIG. 9.

From FIG. 12 it will be seen that the holder 322 of coaster 320 comprises a generally circular base 324 terminating on its periphery in an upwardly curved sidewall 326 defining an upwardly open receptacle. In the lower surface of the base 324 is a circular recess 328 encircled by a relatively narrow depending rim 330 from which a plurality of support legs 332 extend for supporting the coaster holder 322 in a spaced relation with whatever table, desk or other item of furniture on which the coupled coaster 320 and can 12 may be placed.

Spaced around the lower edge of rim 330 are a plurality of inwardly projecting tips 334 (see FIG. 15) adapted to retain the edge of a thin indicia disc 335 beneath which there may be placed pictures, advertisements, money, trinkets or other items felt likely to appeal to a potential user of the coaster 320. Preferable the circular base is molded of a semi-resilient inert plastic such as polyethylene or polypropylene, whereby the holder 322 can be easily flexed or twisted somewhat to assist in the insertion or removal of the aforementioned indicia disc 335 and/or other objects past tips 334 into or from the circular recess 328.

Disposed within the holder 322 is an absorbent member 336 having a generally circular center section 338 and a relatively thin circular flange 340 extending outwardly from the center section 338. As will be seen best from FIG. 12, the outer portion of flange 340 is positioned on an annular rim 342 surrounding a relatively shallow recess 344.

Absorbent member 336 is held in position within holder 322 by retainer 346. Retainer 346 is provided with an annular collar 348 having a central opening 350 (see FIG. 14) sized to freely receive central section 338 of absorbent member 336. A plurality of connectors 352 extend downwardly from collar 348 through holes 354 in flange 340 and into annular groove 356 located in base 324 around the outer edge of rim 342. The width of the groove 356 is such that it will frictionally but releasable retain the lower ends of connectors 352. Thus, assembly of the coaster 320 may be accomplished simply, quickly and conveniently either initially or after disassembly for washing by positioning collar 348 of retainer 346 over flange 340 of absorbent member 336 and pressing connectors 352 into annular groove 356 of base 324.

As will be understood, absorbent member 336 may be formed of a porous plastic as described heretofore in this specification or of other porous hydrophilic materials, such as relatively dense sponge material or semi-resilient felt of the nature used for points in marking pens. Also, the absorbent member 336 may be assembled using two or more stamped discs, but if it is made using porous plastic it preferably is molded in an appropriate die as a finished component.

Extending upwardly from the inner edge of collar 348 is a generally cylindrical wall section 358 which freely fits over and extends to about the top of the central section 338. Spaced around the upper edge of and extending outwardly from wall section 358 are a plurality of radially resilient contact elements 360. The contact elements 360 curve downwardly and terminate in distal ends 362 defining a circular line having a diameter several thousandths of an inch larger than the diameter of the largest annular peripheral surface 22 of foot 18 of can 12 to be used with the coaster 320. Thus, as best shown in FIG. 12, as the can 12 is placed on the coaster 320, contact between distal ends 362 and surface 22 will bias the contact elements 360 inwardly. Such biasing will create sufficient spring pressure between distal ends 362 and surface 22 to frictionally couple the can 12 and coaster 320 together., whereby tile coaster will remain on the bottom of the can as the can is picked up and moved about by the user.

The retainer 346, including its collar 348, cylindrical wall section 358, contact elements 360 and connectors 352, preferably is injection molded of a semi-resilient inert plastic such as polyethylene or polypropylene. As an injection molded component of such materials is not pervious to moisture, it is necessary to provide the cylindrical wall 358 with a plurality of openings 362 spaced therearound, and collar 348 (see FIG. 14) with a variety of apertures—large apertures 364 and smaller capillary apertures and slits 366. The purpose of the smaller apertures and slits 366 is to provide a means for temporarily holding excess moisture which may be present or formed on collar 348 and which might otherwise tend to run to one side and perhaps drip from the collar 348 or run back down the side of the can 12 should the can 12 and coupled coaster 320 be lifted and tilted suddenly by the user. Upon subsequent return of the can 12 and coaster 320 to a level vertical position any such excess moisture will be drawn from the capillary apertures and slits 366 by the higher capillary attraction of the pores in absorbent member 336.

In the present embodiment the foot 18 of can 12 does not sit directly on the flange 340 of absorbent member 338 while the can and coaster 320 are coupled together. Rather the foot is positioned on a plurality of small projections 367 spaced around the upper surface of collar 348 of retainer 346 in the annular area underlying the foot 18 of can 12. The projections 367 are of such height that a capillary space in created between the bottom of foot 18 and the upper surface of collar 348. This capillary space plus the presence of the multiple apertures of various sizes in collar 348 effectively provide the same basic advantages as direct contact. Thus, for purposes of this invention, the annular portion extending around the upper surface of flange 340 in the area of the openings 364 forms a seat over which the foot 18 of can 12 is positioned when it is coupled to the coaster 320. For venting of the space 372 within foot 18 when it is positioned on collar 348 over flange 340, the larger apertures 364 have been found to serve adequately as air channels.

Particularly should the absorbent member absorb a relatively large quantity of cold moisture in a short period of time, the lower surface of base 324 might become cool enough to collect condensate. To avoid this possibility, circular recess 344 provides an air space to insulate the base from the cold moisture contained in absorbent member 336.

Within the open upper end of sidewall 326 is an annular bead or lip 376 sized to fit the upwardly projecting annular rim 70 of can 12. As best illustrated in FIG. 11, by inverting the coaster 320, it may be placed over the upper end of can 12 with lip 376 sealable engaging rim 70. As explained in connection with other embodiments of this invention, such engagement will seal the upper end of the can 12 from the atmosphere and protect the contents of an opened can against contamination and loss of freshness. Also, the coaster will avoid spillage should the can be inadvertently tipped over.

Obviously many modifications, variations and substitutions of materials and dimensions of the present invention are possible in light of the teachings of this specification. Also, it will be understood that the use of coasters constructed according to the present invention is not limited to cold beverages as such coasters may very conveniently be used with containers of hot beverages or simply with containers which are wet and would otherwise stain a tablecloth or otherwise create a problem if not placed on a coaster. It is to be understood, therefore, that the foregoing description and appended drawings are for illustrative purposes only and are neither intended nor desired to limit the scope of this invention. Having thus described various embodiments of my invention, what is claimed as new and novel and desired to be protected by Letters Patent is as follows.

I claim:

1. A coaster for use with a beverage container of the type having an upper rim and a recessed lower surface surrounded by a downwardly depending foot provided internally with an annular peripheral surface, said coaster comprising (a) a generally cylindrical holder having an open end, (b) an absorbent member disposed within said holder and provided with
(i) a generally circular upper center section,
(ii) a lower circular portion of a diameter larger than that of said upper center section,
(iii) the upper surface of said lower circular portion outwardly of said upper center section providing an annular seat sized to receive the foot of the container upon placement of the container on said coaster, and
(iv) a multiplicity of interconnecting capillary spaces sized to absorb moisture and condensate from the container while the container is disposed on said coaster with its foot positioned on said seat,
(c) means for releasably coupling said coaster to the container as the container is placed on the coaster with its foot positioned on said seat, said coupling means comprising
(i) a generally annular coupling member positioned on said absorbent member inwardly of said seat, and
(ii) a plurality of semi-resilient contact elements spaced around and extending outwardly of said coupling member for frictional engagement with the annular peripheral surface within the foot of the container upon placement of the container on said coaster.

2. A coaster according to claim 1, characterized by vent means providing for communication between the atmosphere and the area formed by the foot between the lower surface of the container and said upper generally circular center section of said absorbent member upon placement of the foot on said annular seat.

3. A coaster according to claim 2, characterized by said vent means comprising at least one vent passage communicating with said closed area and radiating outwardly therefrom through said annular seat to a position beyond the foot of the container for free communication with the atmosphere.

4. A coaster according to claim 1, characterized by said absorbent member comprising a hydrophilic porous plastic material wherein said interconnected capillary spaces have an average pore size in the range of about 15–140 microns and a void volume of about 20–60 percent.

5. A coaster according to claim 1, characterized by
(a) said coupling member extending upwardly from said seat to a position within the foot of the container when said coaster is coupled to the container,
(b) said contact elements comprising resilient tabs radiating outwardly of and curving downwardly from adjacent the upper edge of said coupling member,
(c) said distal ends of said tabs being in frictional contact with and biased inwardly by the peripheral surface of the foot of the container while said coaster is coupled to the container.

6. A coaster according to claim 5, characterized by
(a) said generally cylindrical holder being made of a semi-resilient form retaining plastic and having
(i) a first section providing a first internal bore terminating in a first open end,
(ii) a second section providing a second internal bore coaxial with said first bore and terminating in a second open end, and
(iii) a non-permeable wall disposed between and isolating said bores from one another,
(b) said absorbent member and said coupling means being mounted in said first bore with said seat facing outwardly of said first open end for the reception thereon of the annular foot of the container.

7. A coaster according to claim 6, characterized by closure means for sealingly engaging the upper rim of the container to form a closure for the container after its upper end has been perforated, said closure means comprising an annular lip provided internally of said second section adjacent said second open end and shaped to slide over and sealingly engage the upper rim of the container.

8. A coaster according to claim 6, characterized by a closure cap having
(a) a substantially flat body portion and
(b) an annular collar extending perpendicularly from said body portion,
(i) the inside diameter of said collar being sized to fit over and frictionally engage the outside periphery of the second section of said holder to close said second open end while said coaster is coupled to the foot of the container, and
(ii) the outside diameter of said annular collar being sized to fit within and frictionally engage the inside periphery of said first section of said holder to close said first open end while said coaster is sealably engaged with the upper rim of the container,
(c) said flat body portion of said closure cap being printable with indicia.

9. A coaster according to claim 6, characterized by indicia carried by the side of the non-permeable wall facing toward said second open end whereby said indicia is visible when said second open end is positioned toward a viewer.

10. A coaster according to claim 9, characterized by
(a) said indicia being provided on a disc separate from said wall, and
(b) means for selectively retaining said disc proximate said wall whereby said disc may be inserted and removed from said coaster.

11. A coaster for use with a beverage can or container having an upper surface surrounded by an upwardly projecting annular rim and a recessed lower surface surrounded by a downwardly depending annular foot provided internally with an annular peripheral surface, said coaster comprising
(a) a generally cylindrical holder made of a semi-resilient form retaining plastic and having
(i) a first section providing a first internal bore terminating in a first open end,
(ii) a second section providing a second internal bore coaxial with said first bore and terminating in a second open end, and
(iii) a non-permeable wall disposed between and isolating said bores from one another,
(b) a generally circular absorbent member
(i) disposed within said first internal bore,
(ii) provided with an annular seat facing outwardly of said first open end and sized to receive the foot of the container, and
(iii) provided with a multiplicity of randomly disposed interconnected capillary spaces sized to absorb any moisture present or forming as condensate on the container while the container is disposed on said coaster with the foot positioned on said seat, (c) means for releasably coupling said coaster to the container as the container is placed on said coaster with its foot positioned on said seat, said means comprising:

(i) a generally annular coupling member fixed relative to said absorbent member inwardly of said seat, and (ii) a plurality of semi-resilient contact elements spaced around and extending outwardly of said coupling member, said contact elements terminating in distal ends positioned for frictional engagement with the interior peripheral surface of the foot as the container is placed on the coaster, (d) an annular lip provided internally of said second section adjacent said second open end, said annular lip being sized and shaped to slide over and sealingly engage the upper rim of the container to form a closure for the container, and (e) a closure cap having (i) a substantially flat body portion and (ii) an annular collar extending perpendicularly from said body portion, (iii) said collar being releasably engagable with both said first and second open ends of said holder whereby said closure cap is selectively attachable to such open end as is not coupled to the container.

* * * * *